United States Patent [19]

Simon et al.

[11] 4,435,638

[45] Mar. 6, 1984

[54] ELECTRIC RANGE SURFACE ELEMENT

[75] Inventors: Donald J. Simon, Indianapolis; Thomas R. Field, Noblesville, both of Ind.

[73] Assignee: Jenn-Air Corporation, Indianapolis, Ind.

[21] Appl. No.: 294,582

[22] Filed: Aug. 20, 1981

[51] Int. Cl.[3] ..... F27D 11/02

[52] U.S. Cl. ..... 219/460; 99/426; 126/39 E; 219/432; 219/433; 219/456; 219/461; 219/467

[58] Field of Search ..... 219/432, 433, 455, 456, 219/460, 461.4, 465, 467, 535, 521; 99/323.5, 426, 427, 440; 126/39 E, 39 BA

[56] References Cited

U.S. PATENT DOCUMENTS

| | | | |
|---|---|---|---|
| 2,270,293 | 1/1942 | Grunder | 219/456 |
| 2,288,967 | 7/1942 | Challet | 219/456 |
| 2,724,043 | 11/1955 | McOrlly | 219/456 |
| 2,856,503 | 10/1958 | More | 219/460 |
| 2,874,261 | 2/1959 | Wolf | 219/456 |
| 3,065,327 | 11/1962 | Coultrip | 219/460 X |
| 3,331,944 | 7/1967 | Burger et al. | 219/455 |
| 3,543,004 | 11/1970 | Morey et al. | 219/433 |
| 3,761,680 | 9/1973 | Ingrao | 219/456 |
| 3,826,897 | 7/1974 | Behr et al. | 219/456 |
| 3,898,430 | 8/1975 | Sego, Jr. et al. | 219/444 |
| 4,249,069 | 2/1981 | Anderson | 219/433 X |
| 4,313,416 | 2/1982 | Lau | 219/456 X |
| 4,332,188 | 1/1982 | Rhear | 99/323.5 |

FOREIGN PATENT DOCUMENTS

| | | | |
|---|---|---|---|
| 47255 | 4/1966 | German Democratic Rep. | 219/432 |
| 437132 | 6/1948 | Italy | 219/455 |
| 770432 | 3/1957 | United Kingdom | 219/456 |

*Primary Examiner*—Volodymyr Y. Mayewsky
*Attorney, Agent, or Firm*—Richard L. Ward

[57] ABSTRACT

A resistance heating element is formed in a spiral pattern to a spherical radius to provide conductive heating for a wok. The resistance heating element is supported by a support which accommodates the spherical surface of the heating element. The heating element can be for either plug-in or permanent installation.

7 Claims, 11 Drawing Figures

ELECTRIC RANGE SURFACE ELEMENT

BACKGROUND OF THE INVENTION

Since a wok has a convex bottom, it is ordinarily supported in use by a ringlike stand which provides a stable support. Such a ringlike stand is used to support a wok over a burner of a range. In the case of a gas range, the stand functions much the same as a grate or spider and holds the wok above the burner head with the proximity and intensity of the flame being controlled by the person doing the cooking. Commonly, an adapter intended for use with a gas burner is used with an electric heating unit. Because such an adapter raises the wok above the surface of the resistance heating element, heating must take place by radiation rather than conduction. Since these resistance heating elements are not intended to be used as radiant heaters, the result is a lack of control as to the amount of heat and as to the time response for raising and lowering the heat. Additionally, overheating of the electric elements, particularly the element block, can occur since heat is trapped by the adapter and the resistance element is essentially flush with the range surface.

SUMMARY OF THE INVENTION

A sheathed electric element is formed in a sprial pattern to a spherical radius to match the spherical radius of a wok.

The electric element is supported to prevent deformation of the element which is intended to directly contact and support a wok in its operative condition wherein the element is typically red-hot and therefore softened.

It is an object of this invention to provide a resistance heating element for heating, by conduction, a vessel having a non-planar bottom surface.

It is a further object of this invention to provide a resistance heating element formed to a spherical radius for use in heating a wok by conduction.

It is another object of this invention to provide a controllable electric heating source for a wok.

It is an additional object of this invention to provide a plug-in electrical resistance heating element for use with a wok. These objects, and others as will become apparent hereinafter, are accomplished by the present invention.

Basically, the present invention provides a raised resistance heating element formed to a spherical radius for heating, by conduction, vessels having a complementary convex bottom surface. Support means hold the heating element in the raised position to permit the venting of excess heat and to further separate the element from the element block and wiring. Alternatively, the heating element may be recessed into the range surface in the case of a permanent installation.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
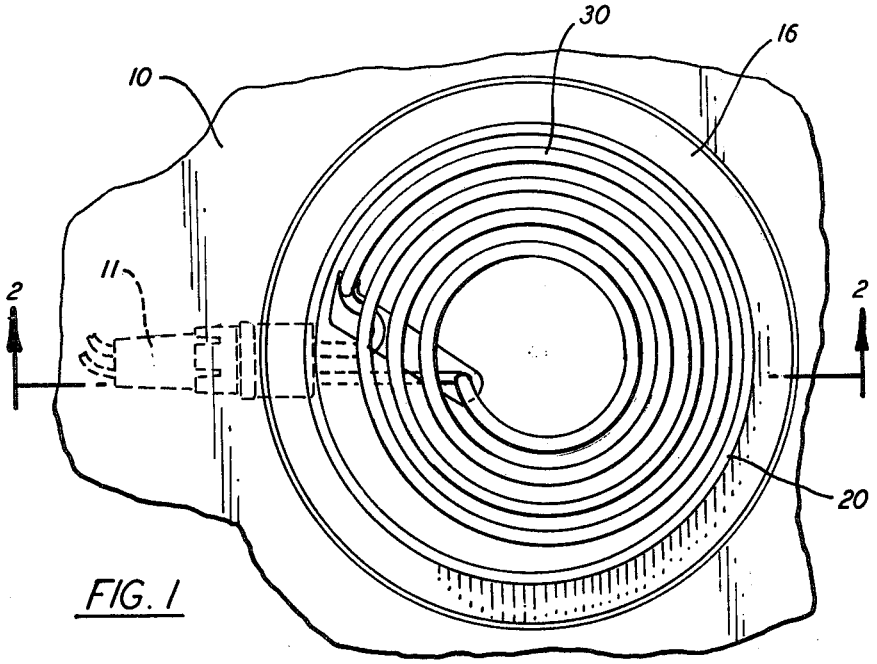
FIG. 1 is a top view of the surface element of the present invention.
Figures 2, 3, 4:
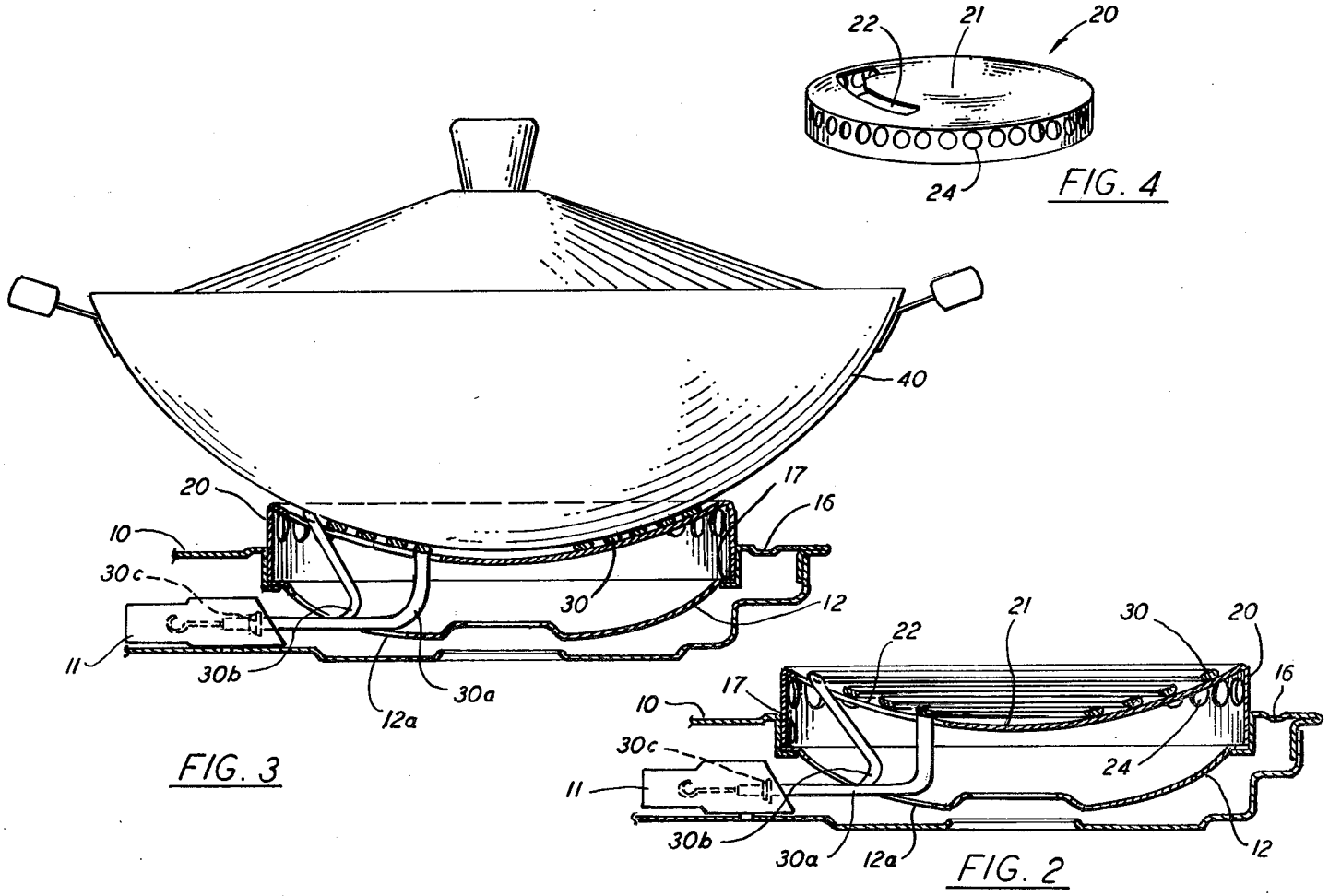
FIG. 2 is a sectional view taken along line 2—2 of FIG. 1.
FIG. 3 is a sectional view corresponding to FIG. 2 with a wok operatively located on the element.
FIG. 4 is a pictorial view of the element support.

In FIGS. 1-3, the numeral 10 designates the surface of a standard electric range or cartrige cooking unit provided with a large circular opening containing a reflector bowl or pan 12 and surrounded by a trim ring 16 which is formed in surface 10. The trim ring 16 has a recessed inner ledge 17 which serves as a support for an element support and reflector bowl or pan 12. Alternatively, the trim ring can be formed as a separate part. Reflector pan 12 has an opening **12*a* therein for inserting the element into the element block or receptacle 11. The recessed inner ledge 17 is suitable for supporting, via a spider, standard electrical resistance heating elements which are operatively inserted into element block or receptacle 11. According to the present invention, however, an element support 20 is provided which is of a generally cylindrical shape, open at one end and having a closed, spherical concave surface 21 at the other end with a slot 22 in the concave surface 21, as is best seen in FIG. 4. A plurality of circumferentially spaced ventilation holes 24 are located in the cylindrical portion of the support 20 near the concave surface 21. The support 20 is adapted to be supported on the inner ledge 17 so that spaced ventilation holes 24 are located above the surface 10. The surface heating unit 30 is a metal sheathed electric resistance heating element which is formed in a spiral pattern to a spherical radius matching that of concave surface 21 and the spherical radius of wok pan 40. The electric heating element 30 is illustrated as having a flattened cross section but may be of a rounded cross section. The element 30 is held above the range surface 10 by support 20 and has ends 30*a* and *b* which extend through slot 22 and opening 12*a*. Ends 30*a* and *b* are connected by grounding means 30*c* and are operatively received in element block or receptacle 11. As best seen in FIG. 3, the wok 40 is in touching contact with the heating element 30 when placed thereon so that heat transfer from the element 30 to the wok 40 is by conduction. Because the element 30 is raised relative to the reflector pan 12 and because of the presence of ventilation holes 24 in support 20, heat does not build up under the cooktop or range surface 10 and overheat the wiring and receptacle 11. The support 20 gives a degree of support to the element 30 when the element is being plugged into and detached from receptacle 11**.

Figure 5:
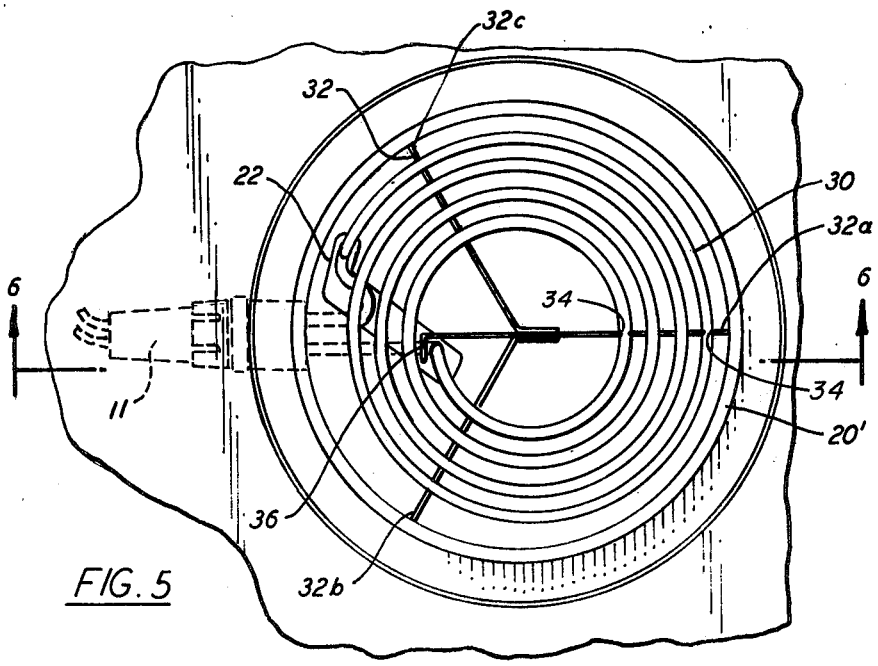
FIG. 5 is a top view of a surface element supported by a spider located on an element support.
Figure 6:
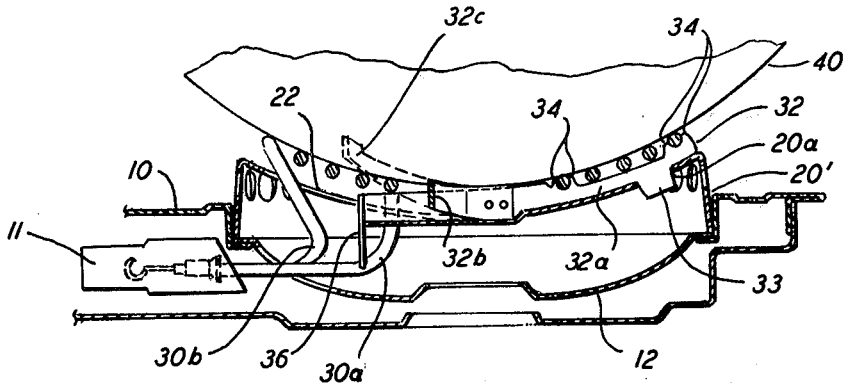
FIG. 6 is a sectional view taken along line 6—6 of FIG. 5 with a wok operatively located on the element.

The cylindrical support 20 of the device of FIGS. 1-4 can be modified by the addition of a spider 32 having arms **32*a-c* and a hold down 36 as shown in FIGS. 5 and 6. The modified support 20' has an additional slot 20*a*** for receiving a tab 33 which is formed on arm 32*a* of spider 32. Hold down 36 extends through slot 22 in support 20' and engages end 30*a* of element 30. Tab 33 and hold down 36 serve to locate the spider 32 on the support 20' and to allow the element 30 and support 20' to be inserted, as a unit, into the range top such that element 30 is engaged electrically by its reception in receptacle 11. Element 30 is also maintained in position relative to spider 32 by pairs of crimped projecions 34 which are formed on arm 32*a*. The advantage of the support 20' over support 20 is that support 20' is not in direct contact with element 30 and so it tends to be cooler than support 20 which directly contacts element 30.

Figure 7:
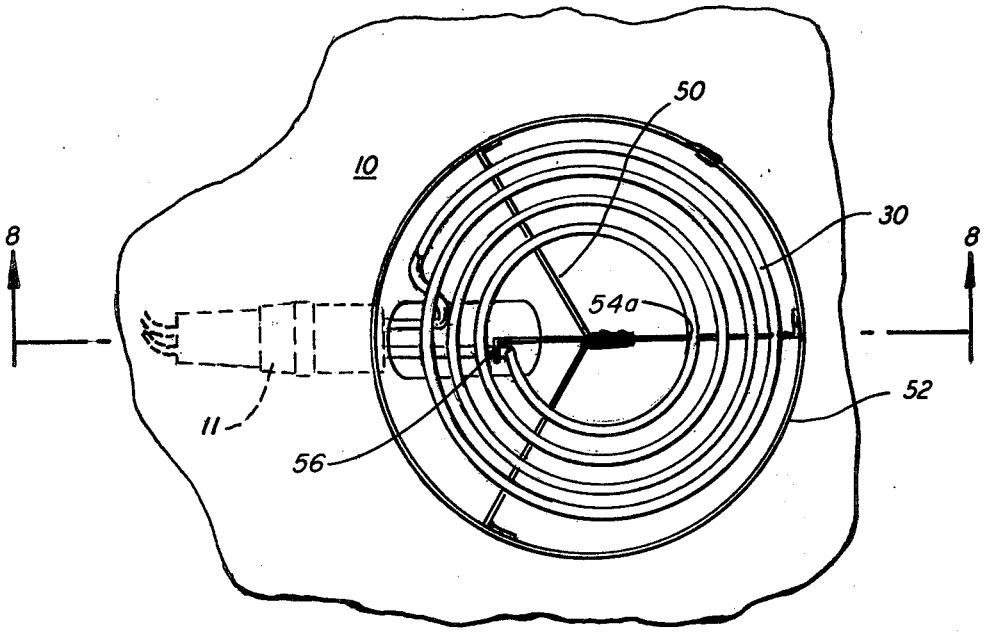
FIG. 7 is a top view of a surface element supported by a spider.
Figure 9:
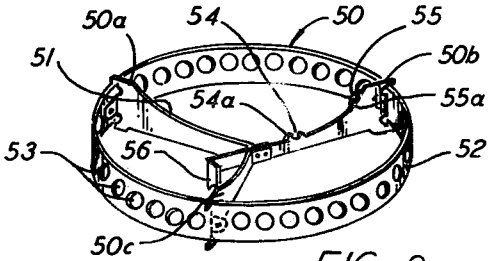
FIG. 9 is a pictorial view of the spider of FIGS. 7 and 8.
Figure 8:
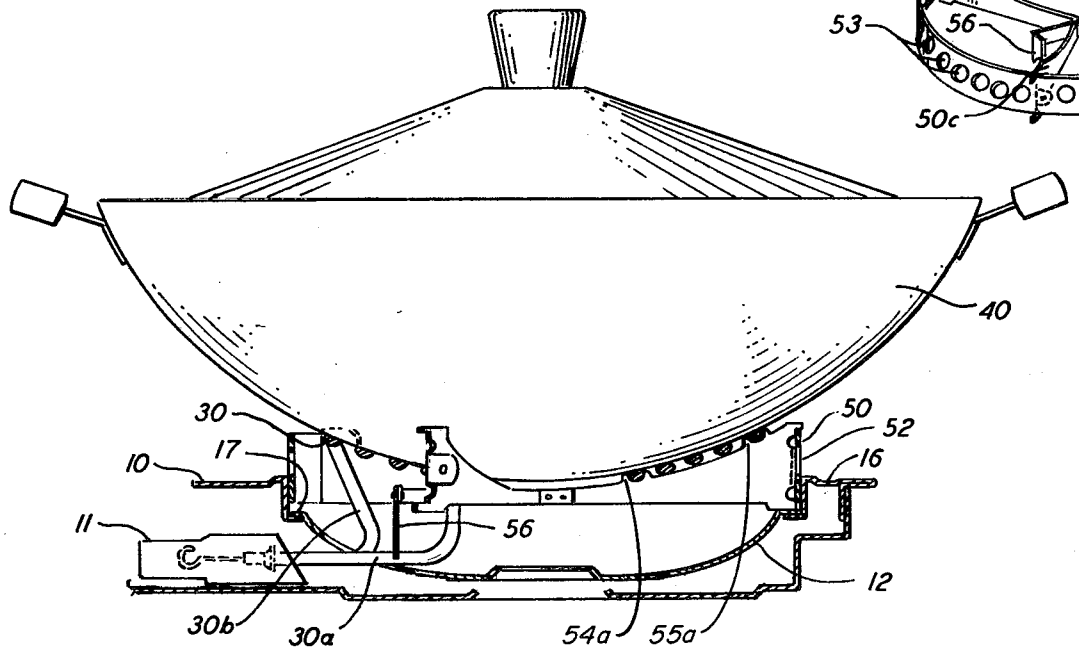
FIG. 8 is a sectional view taken along line 8—8 of FIG. 7 with a wok operatively located on the element.

The cylindrical support 20 of the device of FIGS. 1–4 can be replaced by a grate or spider. Referring now to FIGS. 7–9, a three-armed grate or spider 50 replaces the support 20 of the FIG. 1 device with the rest of the structure being identical and given the same numbers. Spicer 50 differs from a conventional spider in the degree and variation in its vertical extent, as defined by surface 51, so as to support the essentially spherical shape of the element 30. Cylindrical metal strip 52 is attached to the ends of arms 50*a–c* and is perforated with vent holes 53 to permit the trapped heat to escape. The metal strip 52 prevents the radiant energy from the element 30 from overheating the adjacent vertical surfaces. The spider 50 has two projecting open slots 54 and 55 to receive respective coils of the element 30 and to hold element 30 in place by crimping the pairs of projections 54*a* and 55*a* which respectively define slots 54 and 55. A downward projecting front hold down 56 extends from spider 50 and engages end 30*a* of element 30 in a guiding relationship for insertion into block 11. Spider 50 offers several advantages over the support 20 in that surface 51 provides a minimal amount of touching contact between the element 30 and the spider 50 so that heat transfer to the spider is minimized.

Figure 11:
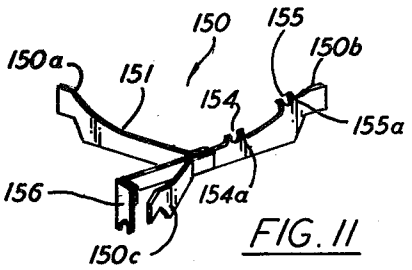
FIG. 11 is a pictorial view of the spider of FIG. 10.
Figure 10:
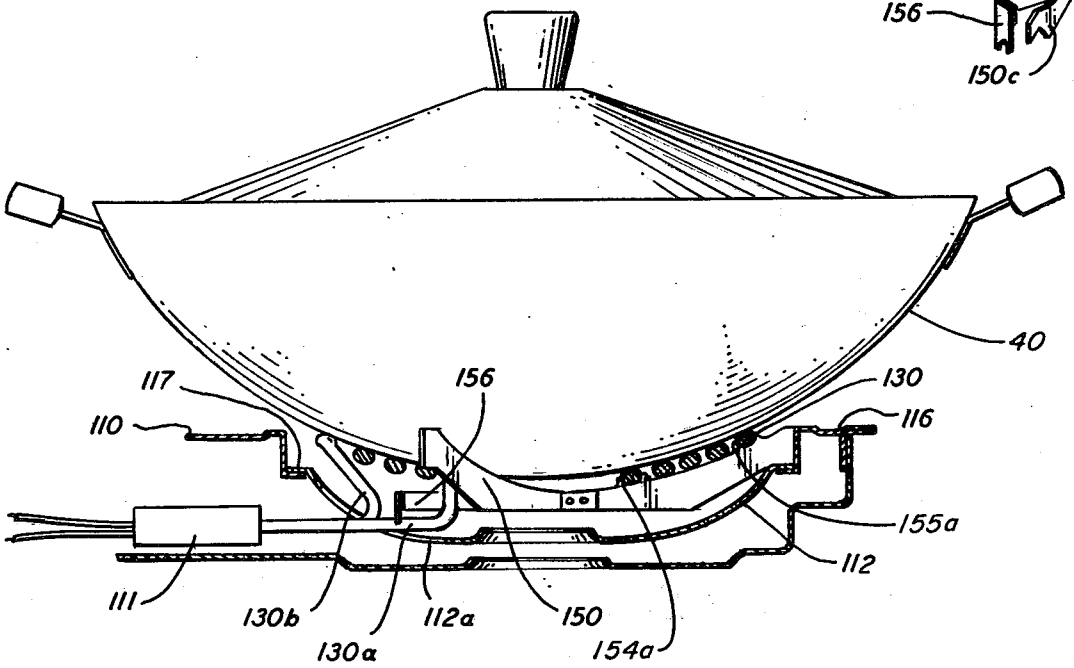
FIG. 10 is a sectional view of a surface element and spider for permanent installation.

In the embodiments of FIGS. 1–9, the element 30 is a plug-in type and the element and its support 20, 20' or 50 are intended to be interchangeable with conventional planar elements and their supports. However, the present invention can be made as a permanent installation where the wok or a similarly configured utensil can be used for other types of cooking, such as sauteing, in addition to the conventional stir-frying. Referring now to FIGS. 10 and 11, the numeral 110 designates the surface of an electric range or cartridge cooking unit provided with a large circular opening containing a reflector bowl or pan 112 and surrounded by a trim ring 116 which is formed in surface 110. The trim ring 116 has a recessed inner ledge 117 which serves as a support for spider 150 and reflector bowl or pan 112. Pan 112 has an opening 112*a* therein through which the ends 130*a* and 130*b* of electrical resistance heating element 130 pass for connnection to block 111. Spider 150 has three arms, 150*a–c* having a curved upper surface 151 which is complementary to that of the element 130. The spider 150 additionally has two projecting open slots 154 and 155 to receive respective coils of the element 130 and to hold element 130 in place by crimping the pairs of projections 154*a* and 155*a* which respectively define slots 154 and 155. A downwardly projecting front hold down 156 extends from spider 150 and engages end 130*a* of element 130 in a guiding relationship. Element 130 is a metal sheathed electric resistance element and is formed in a spiral pattern to a spherical radius matching that of the curved upper surface 151 of arms 150*a–c* and the spherical radius of wok pan 40. This arrangement is subject to the reverse abuse of the conventional wok adapter in that a standard flat bottomed pan could be used which would have minimal touching contact so that a large amount of radiant heat would be produced. This can be overcome by providing a pan sensor at the center of the coil of element 130 so that the burner would be enabled only when contacted by a utensil of the proper configuration.

Although preferred embodiments of the present invention have been illustrated and described, other changes will occur to those skilled in the art. It is therefore intended that the scope of the present invention is to be limited only by the scope of the appended claims.

What is claimed is:

1. In an electric range or the like having a top cooking surface defining an opening having ledge means therein, an electric surface unit for heating a utensil having a large convex bottom surface by conduction comprising:

support means supported by said ledge means and having an elevated support surface disposed substantially above said top surface and including a generally spherical portion;

heating element means formed in a spiral pattern to a generally spherical radius and adapted to be supported in a generally predetermined non-deformable posture on said elevated support surface, said support means positioning the underside of said heating element means spaced vertically above said top surface for permitting a cooling cross flow of air therebetween, said heating element means being operable for providing a heat conducting relationship with a complementary configured utensil when in an operative condition and for being supported by said support means with the large convex bottom surface extending radially beyond the limits of said heating element means; and a perforate element generally enclosing said heating element means and the vertical space between said heating element means and said top surface, said perforate element permitting airflow into and out of said air space while effectively shielding the adjacent top surfaces from radiation heating whereby when said heating element means is in an operative condition heat is provided for said utensil while heating of the subjacent top surface is inhibited.

2. The electric surface unit of claim 1 wherein said heating element means is adapted to be replaceably received in an electrical connector so that said electric surface unit is interchangeable.

3. The electric surface unit of claim 1 wherein said support means is a spider having a plurality of arms and said support surface is formed on said plurality of arms.

4. The electric surface unit of claim 3 wherein said spider includes means for securing said heating element means thereto.

5. The electric surface unit of claim 3 wherein said perforate element comprises a cylindrical, perforate metal strip attached to the ends of each of said plurality of arms.

6. In an electric range or the like having a top cooking surface defining an opening having ledge means therein, an electric surface unit for heating a utensil having a large bottom surface by conduction comprising:

support means supported by said ledge means and having a plurality of arms for defining an elevated support surface disposed substantially above said top surface;

heating element means formed in a convoluted pattern and adapted to be supported in a generally predetermined posture on said elevated support surface, said support means positioning the underside of said heating element means spaced vertically above said top surface for permitting a cooling cross flow of air therebetween, said heating element being operable for providing a heat conducting relationship with said large bottom utensil; and a perforate element generally enclosing said heating element means and the vertical space between said heating element means and said top surface, said perforate element permitting airflow into and out of said air space while effectively shielding the adjacent top surfaces from radiation heating whereby when said heating element means is in an operative condition heat is provided for a utensil having a large bottom surface extending radially beyond the limits of said heating element means while heating of the subjacent top surface is inhibited.

7. The electric surface unit of claim 6 wherein said heating element is formed to a generally spherical radius and is supported in a generally predetermined non-deformable posture on said elevated support surface.

* * * * *